US010787337B2

(12) United States Patent
Bourgeois

(10) Patent No.: US 10,787,337 B2
(45) Date of Patent: Sep. 29, 2020

(54) MODULE AND MACHINE FOR PROCESSING FLAT OBJECTS WHICH IS PROVIDED THEREWITH

(71) Applicant: BOBST MEX SA, Mex (CH)

(72) Inventor: Sacha Bourgeois, Bussigny (CH)

(73) Assignee: BOBST MEX SA (CH)

( * ) Notice: Subject to any disclaimer, the term of this patent is extended or adjusted under 35 U.S.C. 154(b) by 524 days.

(21) Appl. No.: 15/027,783

(22) PCT Filed: Sep. 25, 2014

(86) PCT No.: PCT/EP2014/002598
§ 371 (c)(1),
(2) Date: Apr. 7, 2016

(87) PCT Pub. No.: WO2015/051883
PCT Pub. Date: Apr. 16, 2015

(65) Prior Publication Data

US 2016/0244292 A1 Aug. 25, 2016

(30) Foreign Application Priority Data

Oct. 8, 2013 (EP) ..... 13004822

(51) Int. Cl.

| | |
|---|---|
| ***B65H 43/00*** | (2006.01) |
| ***B65H 29/24*** | (2006.01) |
| ***B65H 29/26*** | (2006.01) |
| ***B65H 29/52*** | (2006.01) |
| ***B31B 70/92*** | (2017.01) |
| ***B31B 50/02*** | (2017.01) |
| *B31B 50/00* | (2017.01) |
| *B31B 50/04* | (2017.01) |

(52) U.S. Cl.
CPC ..... *B65H 43/00* (2013.01); *B31B 50/02* (2017.08); *B31B 70/92* (2017.08); *B65H 29/245* (2013.01); *B65H 29/26* (2013.01); *B65H 29/52* (2013.01); *B31B 50/005* (2017.08); *B31B 50/04* (2017.08); *B65H 2301/531* (2013.01);
(Continued)

(58) Field of Classification Search
CPC ..... B65H 43/00; B65H 29/245; B65H 29/26; B65H 29/52; B65H 2407/10; B65H 2701/71; B65H 2601/2611; B65H 2402/40; B65H 2301/531; B65H 2701/176;
(Continued)

(56) References Cited

U.S. PATENT DOCUMENTS 2,461,290 A * 2/1949 Di Giacomo ..... B65G 11/023 198/400
3,796,424 A * 3/1974 Fox ..... B07C 1/02 271/1
(Continued)

FOREIGN PATENT DOCUMENTS

JP H0286908 U * 7/1990 ..... B65G 11/00

OTHER PUBLICATIONS

International Search Report dated Jan. 16, 2015 issued in corresponding International patent application No. PCT/EP2014/002598.

*Primary Examiner* — Nathaniel C Chukwurah
*Assistant Examiner* — Mobeen Ahmed
(74) *Attorney, Agent, or Firm* — Ostrolenk Faber LLP

(57) ABSTRACT

A module (M) for a machine (100) for processing flat objects having a support structure (1, 2, 3, 4) above which the flat objects are transported along a given transport path. The module includes a discharge system for such objects, the discharge system is capable of discharging any flat object which falls below the transport path.

9 Claims, 4 Drawing Sheets

(52) U.S. Cl.
CPC .... *B65H 2402/40* (2013.01); *B65H 2404/692* (2013.01); *B65H 2407/10* (2013.01); *B65H 2601/2611* (2013.01); *B65H 2701/176* (2013.01); *B65H 2701/71* (2013.01)

(58) Field of Classification Search
CPC . B65H 2404/692; B31B 50/005; B31B 50/04; B31B 50/02; B31B 70/92
USPC ..... 493/38, 81, 147, 161, 201; 53/53, 54
See application file for complete search history.

(56) References Cited

U.S. PATENT DOCUMENTS 3,882,316 A * 5/1975 Garris ..... B07C 5/3404 250/559.15
4,501,106 A * 2/1985 Treiber ..... B65B 11/54 53/66
4,541,824 A * 9/1985 Muller ..... B65H 5/28 198/371.2
4,570,412 A * 2/1986 Stockmeier ..... B65B 61/28 198/389
4,593,515 A * 6/1986 Margraf ..... B65B 57/16 53/502
4,870,799 A * 10/1989 Bergerioux ..... B65G 1/1376 53/55
4,976,089 A * 12/1990 Reichelt ..... B65B 57/04 53/389.3
6,634,485 B1 10/2003 Cailbault
9,511,965 B2 * 12/2016 Hatano ..... B65H 29/247
2010/0210436 A1 * 8/2010 Taketsugu ..... B65H 29/62 493/29
2013/0298499 A1 * 11/2013 Yamagata ..... B65B 57/14 53/268

* cited by examiner 16
22
15
A 1
16
22

5
15
C
2

MODULE AND MACHINE FOR PROCESSING FLAT OBJECTS WHICH IS PROVIDED THEREWITH

CROSS-REFERENCE TO RELATED APPLICATIONS

The present application is a 35 U.S.C. §§ 371 national phase conversion of PCT/EP2014/002598, filed Sep. 25, 2014, which claims priority of European Patent Application No. 13004822.6, filed Oct. 8, 2013, the contents of which are incorporated by reference herein. The PCT International Application was published in the French language.

TECHNICAL FIELD OF THE INVENTION

The present invention relates to a module for a machine for processing flat objects. The invention also relates to a machine for processing flat objects which is provided with one or more modules.

BACKGROUND OF THE INVENTION

The invention is used in a particularly advantageous manner, but not exclusively, in the field of production of packaging boxes, in particular boxes for medicaments.

In the packaging industry, the production of boxes is conventionally carried out in line, by folding and gluing cutouts using a machine which is generally called a folder/gluer. Such a processing machine is generally in the form of a series of modules in which there are distributed the different functional arrangements which are responsible for carrying out the large number of elementary operations which are required for producing the boxes. Each module has its own system for transporting the cutouts, generally roller or belt type transporters, but the assembly is arranged so that the conveying operation is generally carried out in a continuous manner over the entire length of the folder/gluer.

During the process of processing the cutouts, some cutouts may leave the transport path and fall underneath, for example, below the transport systems of the modules of the machine. These cutouts may land on portions of machines, positioned in a balanced state, or may even fall on the ground below the machine. If these cutouts are accessible by the operator of the machine, it is possible for the operator to grab them and reintroduce them into the production flow, for example, at the input of the machine or the module into which they have fallen.

Alternatively, if the cutouts are not readily accessible, the operator may push them and/or cause them to fall, for example, by using a compressed air gun which generates dust and contamination which then risk clogging the machine and preventing the correct operation thereof, or polluting and soiling the current production. Furthermore, the use of such a gun may result in the cutouts flying away into the machine and becoming deposited at a different location, which impairs the correct operation thereof and is not at all efficient since the operator has to restart his operation.

Furthermore, in the field of production of medication packaging, very strict practices require specific operating conditions, in particular when a packaging batch is changed, that is to say, when a new packaging which is different (for example, which has a different size, a different basis weight, a different color or even with printing in a different language) is introduced into the machine, the users wish to be sure that the machine has been correctly cleared of all the cutouts of the preceding batch in order to prevent any mixing at the outlet of the machine. This is because, if the dimensions of the packaging are similar, but nonetheless different, occurrences of mixing cannot necessarily be detected with the naked eye and result in problems in the remainder of the production process.

Consequently, not only must all the individual modules be empty and no longer contain cutouts of the different preceding batch, but the machine itself must further be emptied of any cutout which might have fallen into it during the processing operation by the machine.

The most simple solution is of course to carry out a visual inspection and a targeted removal of the fallen cutouts which are found by the operator of the machine. This inspection is nonetheless dependent on the attention of the operator. He may in theory not carry out this inspection as a result of inattention or lack of time. He may also carry it out in a partial manner and in this instance the use of a compressed air gun may bring about a clogging of the machine, if not the return of the cutouts inside the machine.

This simple solution therefore does not ensure optimum and certain clearance of the machine. Furthermore, for obvious safety reasons, it is preferable to prevent an operator from carrying out an operation in which he would introduce his hand or arm into the machine to search for fallen cutouts.

SUMMARY OF THE INVENTION

Statement of Invention

An object of the invention is consequently to provide a module for a machine for processing flat objects, which module improves the solutions of the prior art. More specifically, one of the objects of the invention is to provide a module which enables it to be ensured that the machine is effectively cleared of the cutouts which have fallen into it during the production process. Another object of the invention is to provide a machine which is simple to use and efficient for discharging such cutouts in complete safety for the user.

In accordance with an aspect of the present invention, a module for a machine for processing flat objects comprises a support structure above which the flat objects are transported along a given transport path.

The module is characterized in that it further comprises a discharge system for such flat objects which is capable of discharging any flat object which falls below the transport path.

A flat object is defined as being any flattened object which has a small thickness, regardless of the shape thereof, the format thereof or the material from which it is constituted, such as a complete sheet, a pre-cut sheet, an assembly of blanks or cutouts which are locally attached to each other, an individual blank or cutout, a folding box, etc. Furthermore, such a flat object may be produced from any material, in particular paper, compact cardboard, corrugated cardboard, plastics material, etc.

According to another aspect, a machine for processing flat objects is provided with at least one module which has one or more technical features described below and claimed.

BRIEF DESCRIPTION OF THE DRAWINGS

The invention will be better understood from the description of several embodiments thereof and the Figures, in which.

DETAILED DESCRIPTION

Figure 1:
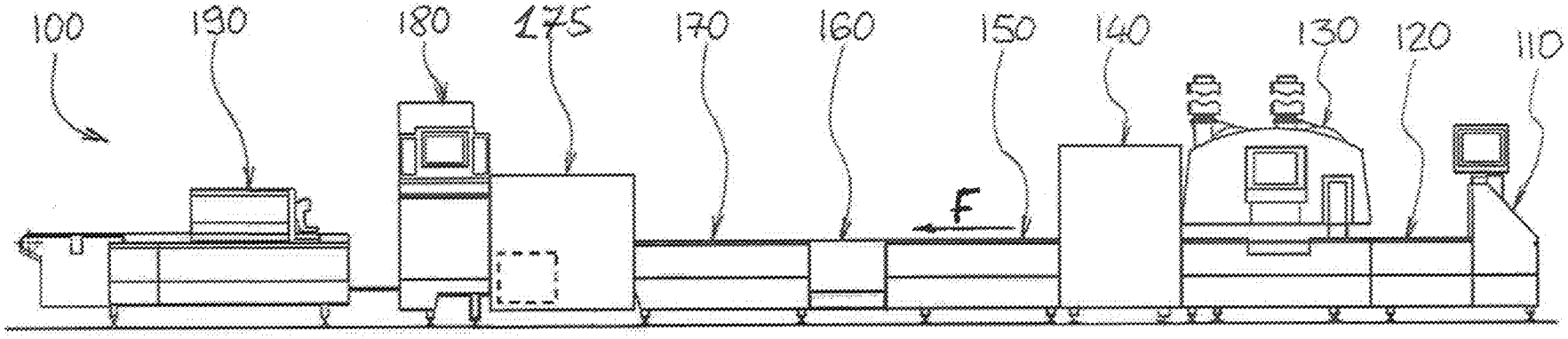
FIG. 1 shows a processing machine of the folder/gluer type provided with modules in accordance with the invention.

FIG. 1 shows a machine for processing planar objects, for example, a folder/gluer type machine 100 for producing packagings. The planar objects are thus in this instance cutouts, most often of cardboard. Such machines are generally formed by a succession of modules M which each carry out one or more folding and bonding operations which are involved in the production process carried out by the machine 100 in order to produce folding boxes.

The folder/gluer 100 is composed of a feeder 110, an alignment module 120, a quality control module 130, a module for embossing Braille characters 140, a pre-breaking module 150, an adhesive gluing module 160, a folding module 170, an ejection module 175, a transfer module 180 and a delivery module 190. Since these various elements are extremely well-known from the prior art, they are not described in detail here, either structurally or operationally.

Figure 2:
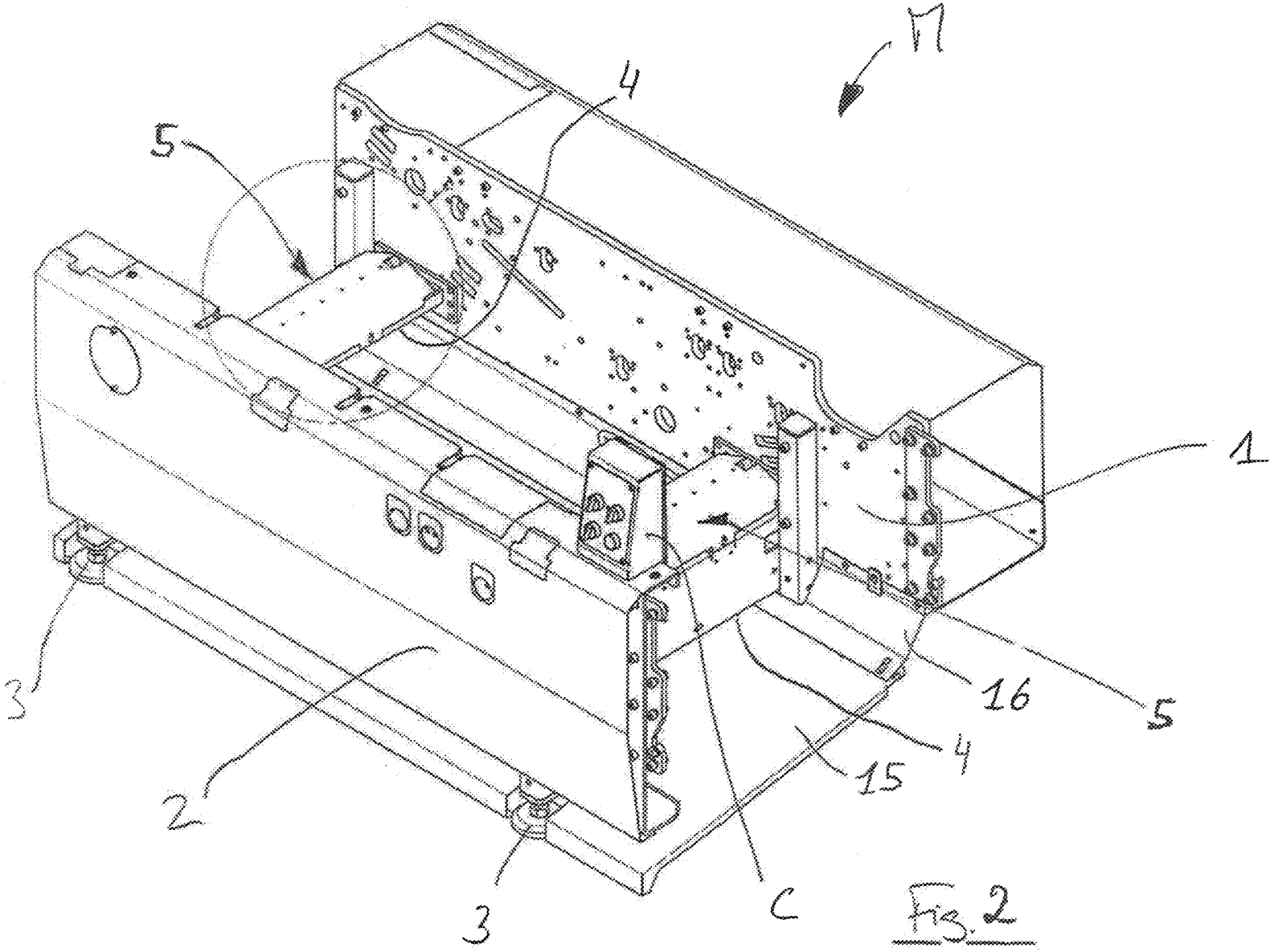
FIG. 2 is a perspective view of a module of the processing machine of FIG. 1.

FIG. 2 is a perspective view of a module M of the folder/gluer 100. The module M illustrated is in a stripped-down form which means that it may be any module of the folder/gluer 100 and the function thereof is not decisive in the context of the description of the present invention. The features which will therefore be described in relation to the present invention can therefore be applied to any production machine module.

The module M comprises a support structure, with two lateral walls 1 and 2 supported by feet 3. The module M also comprises two cross-members 4 which mechanically connect the lateral walls 1 and 2 together. It is naturally possible to provide a single cross-member 4 or more than two cross-members 4 in accordance with the length of the module, for example, the illustration of FIG. 2 not being limiting. The support structure is located below the working zone in which the processing of the cutouts is carried out. The cutouts are transported along a given transport path above the support structure.

According to the invention, the processing machine, and more specifically the module M, is provided with a system for discharging the cutouts. In a first production variant, the discharge system comprises deviation means. The deviation means are capable of discharging any cutout which falls below the transport path, by deviating the fall of the cutout toward a dedicated recovery zone.

Figure 3B:
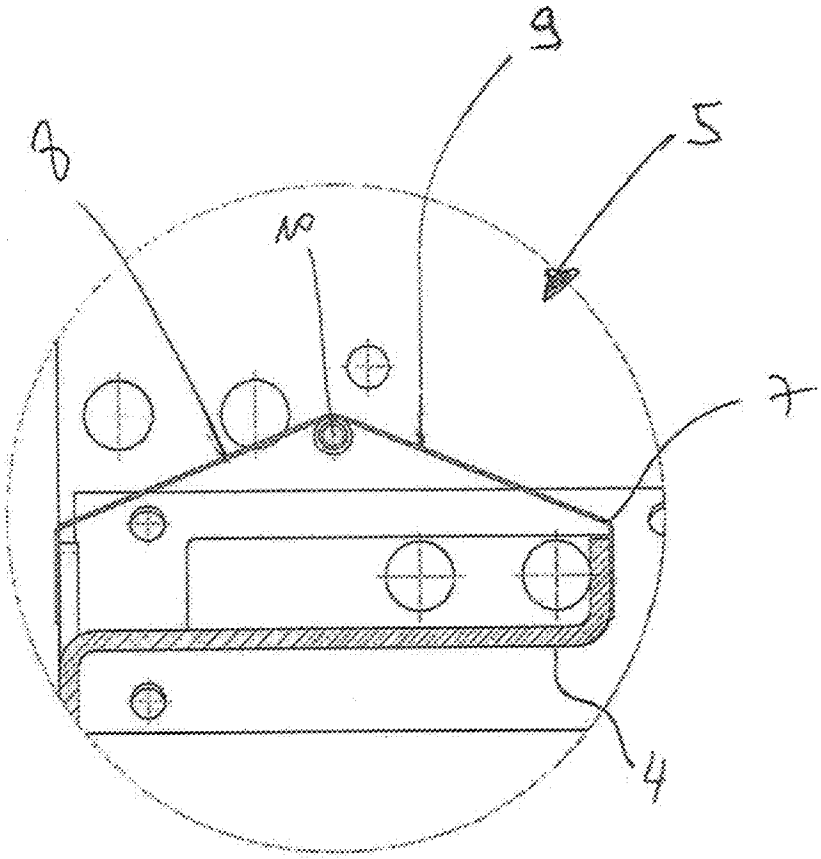
FIGS. 3A and 3B are detailed views of an embodiment of the invention.
Figure 3A:
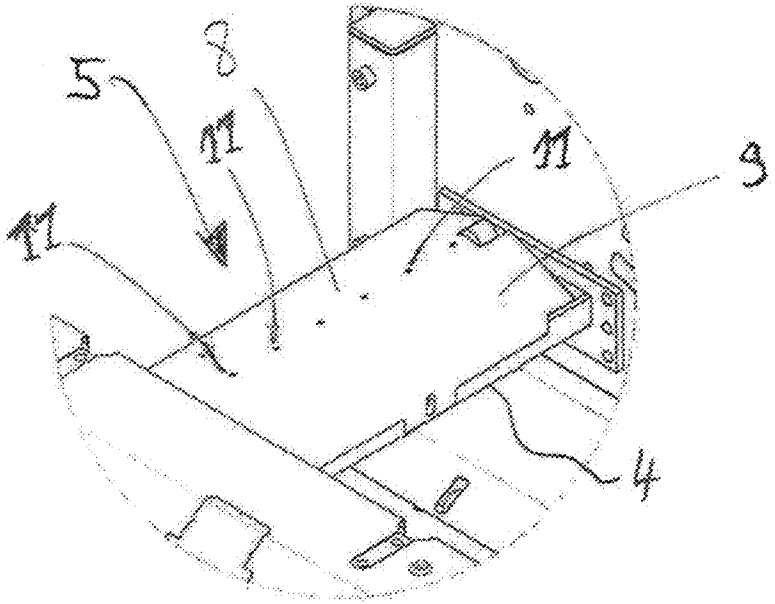

FIGS. 3A and 3B show details (FIG. 3A as a perspective view, FIG. 3B in section) of the cross-member 4 referred to in FIG. 2. Preferably, the redirection means comprise at least a first redirection member 5 which is capable of redirecting the fall of the cutouts in a downward direction when these cutouts arrive above a support structure portion.

The first deflection member 5 is advantageously positioned in an inclined manner, above a support structure portion which extends below the transport path for the cutouts. The first deflection member 5 advantageously comprises at least one inclined plane which is orientated in a substantially longitudinal direction relative to the transport or circulation direction of the cutouts (arrow F in FIG. 1).

The first deflection member 5 is preferably fixedly joined to the support structure portion above which it extends. In this embodiment, the first deflection member 5 is in the form of a cover 7 which is fixedly joined to the cross-member 4. This cover 7 is not flat, but has a convex shape with two inclined planes 8 and 9 in the form of a roof. The object of this specific form is to create an unstable position for a cutout which would fall above the cross-member 4.

This feature enables the problem of the prior art to be solved, that is to say, it prevents the cutouts from being deposited on the cross-member 4, all the more readily when the size of the cutout is less than the width of the cross-member 4.

By giving a shape with two inclined planes to the cover 7, any cutout will continue to fall into the machine as a result of gravitational force. The cover 7 may also have a single inclined plane, the important factor being the instability of the position for a fallen cutout.

In a second production variant, the discharge system preferably comprises first expulsion means which are capable of discharging any cutout which is present on the first deflection member 5. In this variant and in order to compensate for the extreme case in which a cutout is located in a balanced state between the two inclined planes 8 and 9 of the cover 7 and remains in this position which is undesirable, it is possible to use additional expulsion means. These first expulsion means force the movement of the cutout in a downward direction.

Advantageously, the first expulsion means comprise at least one blowing member which is capable of generating a pulsed flow of air in the region of the upper surface of the first deflection member 5, that is to say, the cover 7.

FIGS. 3A and 3B illustrate the blowing member which comprises a conduit 10 (FIG. 3B) and one or more nozzles 11 (FIG. 3A). The compressed air used can easily be tapped from the machine which generally uses compressed air in some production operations.

These expulsion means are of course optional and it is possible to choose to increase the inclination of the planes 8 and 9 in order to dispense with them. It is also possible to use other equivalent means, for example, mechanical elements which push a fallen cutout, such as, for example, a roller which is fitted between the two inclined planes 8 and 9 which is capable of pushing the cutout from one side or the other.

Such expulsion means may be implemented at the command of the operator, using a command C, or in an automatic manner, or even function permanently.

Preferably, the deviation means comprise at least a second deflection member which is capable of deviating the fall of the cutouts toward the dedicated recovery zone, when these cutouts arrive below the support structure. Each second deflection member is advantageously positioned in an inclined manner, below a support structure portion which extends below the cutout transport path.

Each second deflection member advantageously comprises at least one inclined plane which is orientated in a substantially transverse direction relative to the transport direction of the cutouts F. The deviation means preferably comprise a single second deflection member which extends below substantially the entire support structure portion which is located below the transport path of the cutouts.

Figures 4A, 4B:
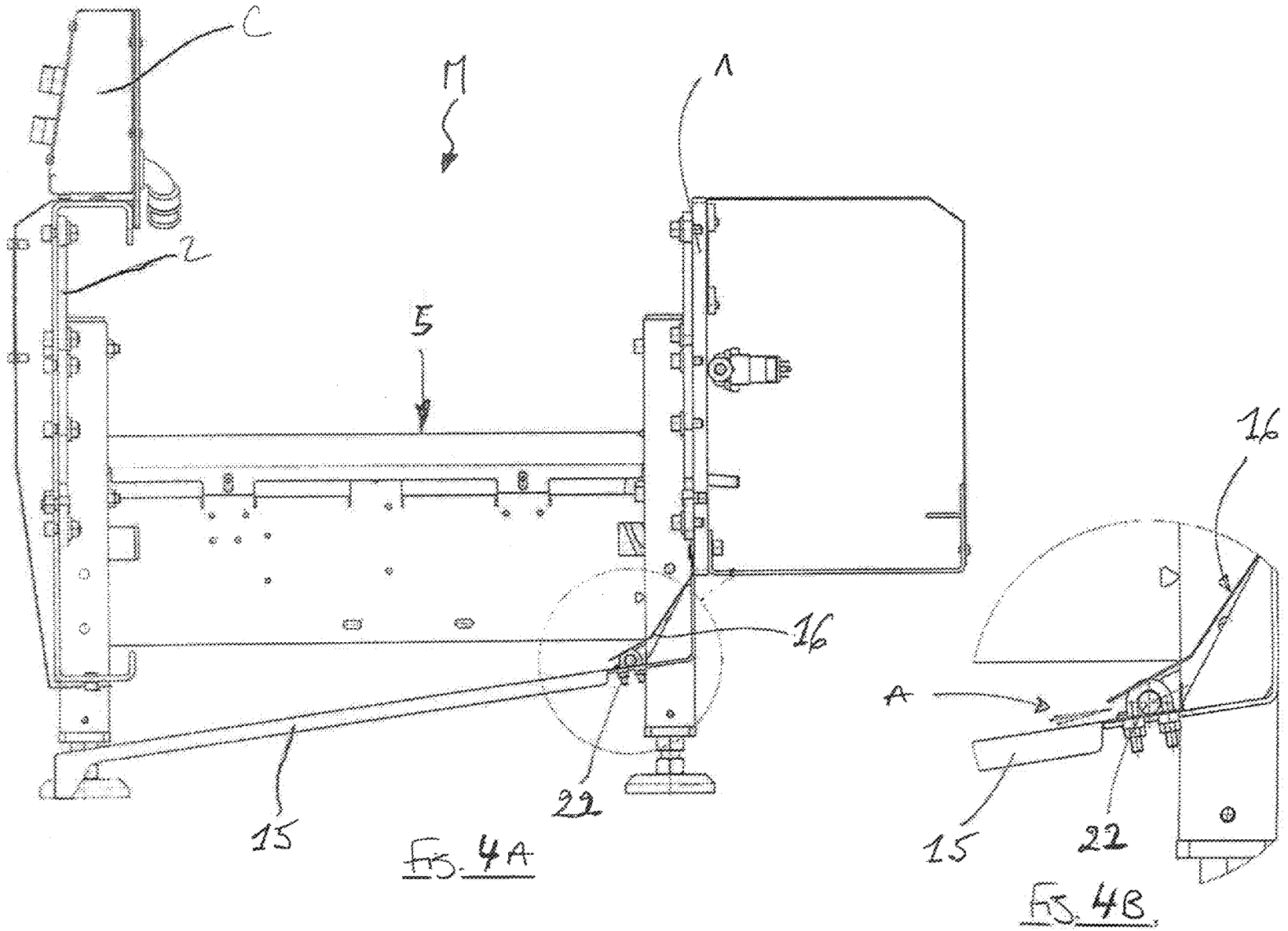
FIGS. 4A and 4B are detailed views of another embodiment of the invention.

The second deflection member comprises two lower covers 15 and 16 (see FIGS. 1 and 4A). These covers 15 and 16 serve to recover the cutouts which fall into the machine from the transport path, but also from cross-members 4 in order to prevent them from falling to the ground below the machine, or below the module M.

More specifically, a first cover 15 forms an inclined plane, in such a manner that the fallen cutouts will all slide toward a recovery zone which is located at the front of the module and of the machine. Consequently, the cutouts do not fall in bulk randomly anywhere below the machine but are directed toward a defined recovery zone. The proposition illustrated is only one example and it is possible to provide a cover 15 which has an inclined plane in another direction, or which terminates in recovery vessels, the idea being that the cutouts are discharged outside the module M or into a zone of the module M which is readily accessible for the operator.

The cover 16, in addition to the function thereof for discharging cutouts, also covers means which prevent the cutouts from remaining blocked on the cover 15. The discharge system advantageously comprises second expulsion means which are capable of discharging any cutout which is present on the second deflection member.

The second expulsion means advantageously comprise at least one blowing member which is capable of generating a pulsed flow of air in the region of the upper surface of a second deflection member.

This blowing member is typically provided with a conduit 22 which blows air laterally, for example, through nozzles, in the direction of the inclined plane 15 (from top to bottom). Arrows A in FIG. 4B illustrate the blown air which thus ensures that the cutouts fall along the inclined plane 15 for the discharge thereof.

This blowing member may be actuated on request by the operator, or automatically, or operate permanently, in a manner similar to those located in the region of the cover 7.

In a preferred manner, the operator uses the command C in order to actuate the discharge means when he wishes to clear the machine of all the cutouts which have fallen.

The cutouts which are cleared by the system can finally be recovered by the operator outside the machine, either manually, or by auxiliary recovery means (for example, vessels) which will be placed, for example, in an appropriate manner at the end of the cover 15.

In this manner, by using the means proposed by the present invention, an operator can readily clear in a certain manner a machine of all the cutouts which might have fallen therein, without manual intervention in the machine. This system is consequently very efficient and complies with safety requirements.

The embodiments illustrated in the present application are illustrated purely by way of example and must not be considered to be limiting. Variations are possible in the context of the protection claimed, for example, by using equivalent means.

The first and second production variant may be used alone or in combination according to the embodiment desired. Only one or a plurality of modules may comprise the discharge system for flat objects. The machine and module portions described above may be formed by any appropriate material. For example, the covers 7, 8, 15 and 16 may be formed from metal or synthetic material.

The invention claimed is:

1. A packaging folder/gluer machine configured to produce packaging by processing flat objects, the machine comprising a feeder, a succession of modules, each module of the succession of modules configured to carry out at least one folding or gluing operation, and a delivery module, a module of the succession of modules comprising:

a support structure above which the flat objects are transported and processed along a given transport and processing path by a transport device for transporting the flat objects above the support structure; and a discharge system for the flat objects configured to discharge a falling flat object which leaves the transport and processing path and falls below the transport and processing path, wherein the discharge system comprises a deviation device configured to deviate a fall of the falling flat object from above the support structure and toward a dedicated recovery zone; and wherein the deviation device comprises:

at least a first deflection member positioned and configured to deviate the fall of the falling flat object when the falling flat object arrives above the support structure portion, wherein the first deflection member is positioned in an inclined manner above at least a part of the support structure; and air holes configured to move the fallen flat object by conveying air to the first deflection member.

2. The machine according to claim 1, wherein each first deflection member comprises at least one inclined plane oriented in a longitudinal direction relative to a transport direction of the flat objects.

3. The machine according to claim 2, wherein each first deflection member is fixedly joined to the support structure portion above which the deflection member extends.

4. The module according to claim 2, wherein the deviation device comprises at least a second deflection member located and capable of deviating the fall of the flat objects toward the dedicated recovery zone when the flat objects arrive below the support structure.

5. The module according to claim 4, wherein each second deflection member is positioned in an inclined manner below the support structure portion and the support structure portion extending below the transport path of the flat objects.

6. The module according to claim 4, wherein each second deflection member comprises at least one inclined plane oriented in a direction which is substantially transverse relative to the transport direction of the flat objects.

7. The module according to claim 6, wherein the deviation device comprises a single second deflection member extending below substantially the entire support structure portion located below the transport path of the flat objects.

8. The module according to claim 7, further comprising a second expulsion device capable of discharging the flat object present on the second deflection member.

9. The module according to claim 8, wherein the second expulsion device comprises at least one blowing member which is capable of generating a pulsed flow of air in the region of the upper surface of the second deflection member.

* * * * *